US005678791A

United States Patent [19]

Maeng

[11] Patent Number: 5,678,791

[45] Date of Patent: Oct. 21, 1997

[54] PROTECTOR FOR LEGS OF GOLF BAG

[76] Inventor: Seop Maeng, 903-7 Gorimri Yongin-Eup, Yongin-Kun, Kyungki-do, Rep. of Korea

[21] Appl. No.: 498,743

[22] Filed: Jul. 6, 1995

[30] Foreign Application Priority Data

| | | | |
|---|---|---|---|
| Jul. 9, 1994 | [KR] | Rep. of Korea | 17023/1994 |
| Aug. 4, 1994 | [KR] | Rep. of Korea | 19752/1994 |
| Sep. 17, 1994 | [KR] | Rep. of Korea | 24324/1994 |

[51] Int. Cl.[6] ..... A63B 55/00

[52] U.S. Cl. ..... 248/96; 248/169; 248/188.6; 206/315.7; 206/315.8

[58] Field of Search ..... 248/95, 96, 97, 248/167, 168, 169, 170, 171, 188.6; 206/315.3, 315.5, 315.7, 315.8

[56] References Cited

U.S. PATENT DOCUMENTS

| | | | |
|---|---|---|---|
| 1,471,766 | 10/1923 | Wolfe | 248/96 |
| 1,606,113 | 11/1926 | Walcott | 248/96 |
| 4,522,299 | 6/1985 | Clark et al. | 206/315.3 |
| 4,798,357 | 1/1989 | Cho | 248/96 |
| 4,949,844 | 8/1990 | Yang | 206/315.3 X |
| 5,042,654 | 8/1991 | Jones | 206/315.3 |
| 5,082,218 | 1/1992 | Hoffman | 206/315.5 X |
| 5,096,148 | 3/1992 | Quellais et al. | 248/96 |
| 5,154,377 | 10/1992 | Suk | 248/96 |
| 5,156,366 | 10/1992 | Anderson | 248/96 |
| 5,236,085 | 8/1993 | Quellais | 248/96 X |
| 5,351,921 | 10/1994 | Chen | 248/96 |
| 5,435,546 | 7/1995 | Rao | 206/315.5 X |
| 5,437,423 | 8/1995 | Sinclair | 248/96 |
| 5,474,175 | 12/1995 | Gattis | 206/315.3 |
| 5,516,064 | 5/1996 | Hsieh | 248/96 |

*Primary Examiner*—Alvin C. Chin-Shue
*Assistant Examiner*—Richard M. Smith
*Attorney, Agent, or Firm*—John J. Connors; Connors & Assoc.

[57] ABSTRACT

A protector for legs of a golf bag that is attached to an outer wall of a golf bag. The protector has recesses for receiving legs and an actuating member for the legs. The legs of the golf bag are pivotally connected at upper ends thereof to the protector. The protector protects the legs of the golf bag against external shock and causes the golf bag to be stably put on a cart.

7 Claims, 6 Drawing Sheets

PROTECTOR FOR LEGS OF GOLF BAG

BACKGROUND OF THE INVENTION

1. Field of the Invention

The present invention relates to a protector for legs of a golf bag, and more particularly to a protector for legs of a golf bag which is provided with recesses adapted to receive the legs of a golf bag to protect these legs against damage during its carriage and custody.

2. Background Discussion

A conventional golf bag is generally provided at its outside with a stand having extendable legs for supporting the golf bag in a tilted position. Although the legs used in the above type of stand have been made of aluminum, steel or synthetic resin material, the synthetic resin and the aluminum material are mostly used from a cost and a weight point of view.

However, since the legs of the stand are slender and prolonged, the legs are easily damaged. Furthermore, the legs are easily bent or broken due to external shock during carriage and custody rather than use. Although the legs are wrapped with a separate fabric cloth for protection because of severe damage of the legs during carriage by an airplane, the above type of fabric cloth can not protect positively the legs.

Referring to FIG. 13, there is shown a conventional golf bag on a golf bag cart. As shown in the drawing, when a prior golf bag "B'" having a stand 2 is put on a golf bag cart 5, only a protruded lower end of the stand 2 comes into contact with a support member 6 of the cart 5. Hence, the golf bag is not easy to be put on the cart and the carriage of the golf bag is unstable. Also, since it is impossible to adjust the extended degree of the legs of the conventional golf bag, the golf bag requires means for adjusting extended distance of the legs, for example, an extension limit band.

SUMMARY OF THE INVENTION

The present invention has been made in view of the above-described problems occurring in the prior art and an object of the invention is to provide a protector for legs of a golf bag which has recesses adapted to receive the legs to protect the legs against external shock and which comes into contact with a golf bag cart at its whole outer surface to facilitate carriage of the golf bag.

Another object of the invention is to provide a protector for legs of a golf bag capable of adjusting an extended distance of the legs without means for limiting an extended distance of the legs.

Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENT," one will understand how the features of this invention provide its benefits, which include convenience in carrying a golf bag with retracted legs on a golf cart.

In accordance with the present invention, the object mentioned above can be accomplished by providing a protector for legs of a golf bag in which the legs are adapted to be extended and retracted by an actuating member, the protector comprising a protector body attached to an outer wall of a golf bag and having one or more longitudinal recess for receiving the legs and the actuating member and pivot holes for pivotally connecting the legs thereto in order to protect the legs against external shock.

In accordance with another aspect of the invention, there is provided a protector for legs of a golf bag in which the legs are adapted to be extended and retracted by an actuating member, the protector comprising two or more bars longitudinally attached to an outer wall of a golf bag with a recess there between for receiving the legs and the actuating member and having pivot holes for pivotally connecting the legs thereto in order to protect the legs against external shock.

The protector may comprise only two bars attached to an outer wall of a golf bag at both sides of the legs, and the bars are protruded downward beyond lower ends of the legs.

BRIEF DESCRIPTION OF THE DRAWINGS

The preferred embodiments of this invention, illustrating all its features, will now be discussed in detail. These embodiments depict the novel and non-obvious the protector of this invention as shown in the accompanying drawing, which is for illustrative purposes only. This drawing includes the following figures (FIGS.), with like numerals indicating like parts.

DETAILED DESCRIPTION OF THE PREFERRED EMBODIMENTS

Figure 2B:
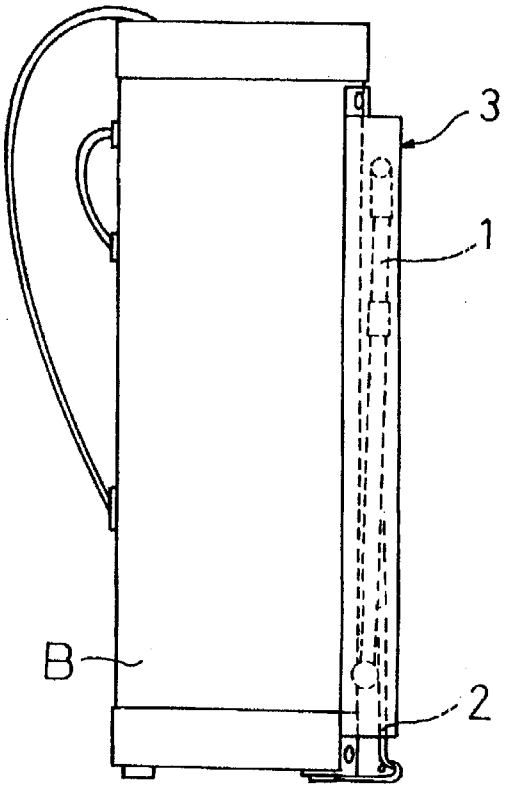
FIG. 2*b* is a side elevation view of the protector which is attached to a golf bag.
Figure 2A:
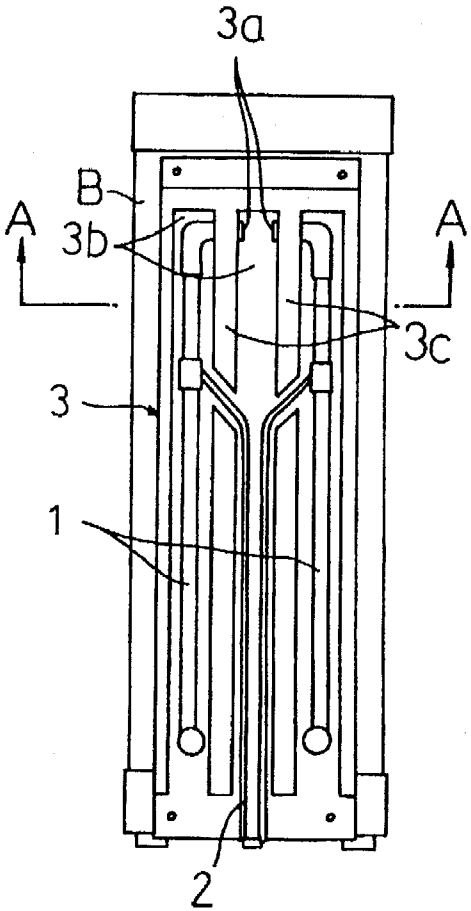
FIG. 2*a* is a front view of the protector of the invention.
Figure 1:
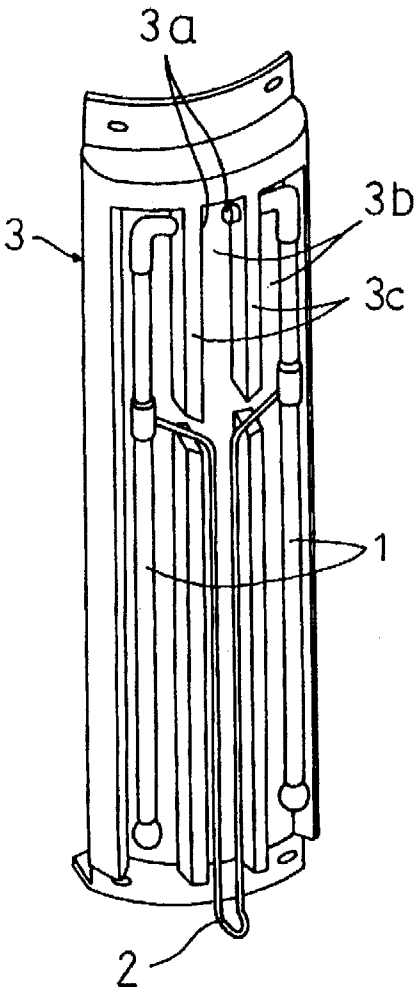
FIG. 1 is a perspective view of a protector for legs of a golf bag according to the present invention to which legs of a golf bag are connected.

Embodiments according to a protector for legs of a golf bag of the present invention will be described with reference to the accompanying drawings hereinafter.

Referring to FIGS. 1 to 5, there is shown a protector for legs of a golf bag according to an embodiment of the present invention. As shown in the drawings, the protector 3 of the invention has longitudinal recesses 3*b*. The recesses 3*b* includes two side recesses adapted to receive legs 1, 1 of a golf bag "B" and a middle recesses adapted to receive an actuating member 2 for extending and retracting the legs 1, 1. Two ribs 3*c* defined by the recesses 3*b* are formed at upper ends thereof with pivot holes 3*a*, respectively.

Figure 5:
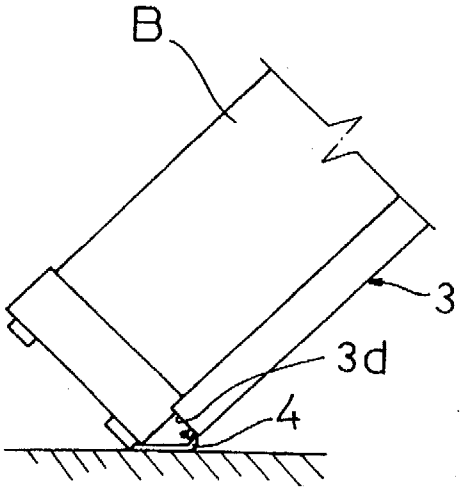
FIG. 5 is a side view of the protector of the invention functioning as stopper for legs.
Figure 13:
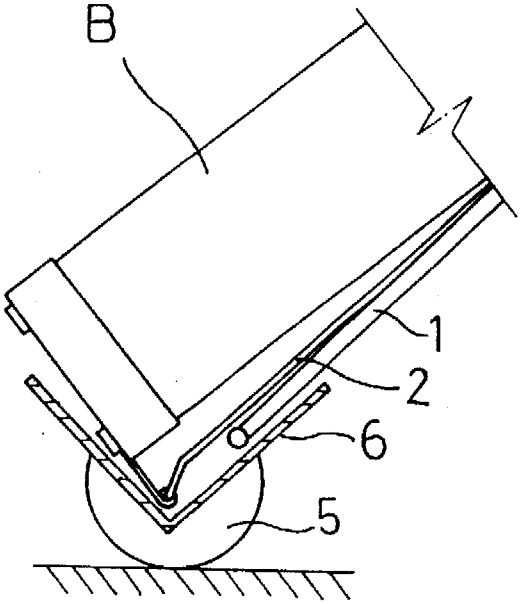
FIG. 13 (PRIOR ART)
FIG. 13 is a side view a conventional golf bag having a stand which is put on a cart.

As known in the golf bag field, the legs 1,1 of the golf bag "B" are extended and retracted by upward and downward movement of the actuating member 2. The protector 3 is attached to an outer wall of the golf bag "B". The legs 1, 1 are elastically biased-toward the bag body "B" by known elastic means and extended and retracted by a known actuating plate 4 (FIG. 5).

Since the protector 3 is attached to an outer wall of the golf bag "B" and upper ends of the legs 1, 1 are pivotally connected to the protector 3, the protector 3 of the invention functions as a bracket for supporting the legs and a housing for receiving the legs.

Figure 3:
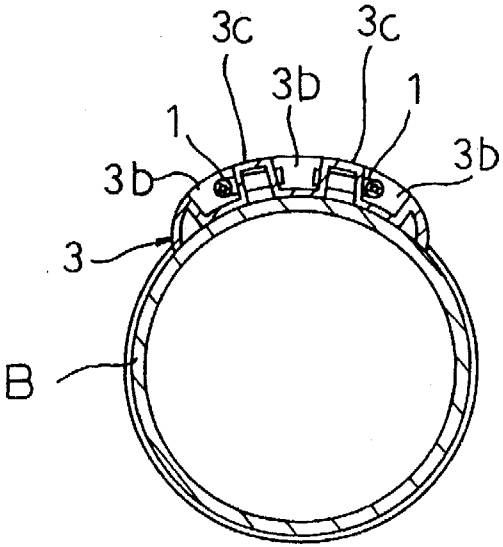
FIG. 3 is a sectional view taken along line A—A of FIG. 2*a;*

The legs 1, 1 of the golf bag "B" are retracted to bag body and received in the recesses 3*b* by the known elastic means during carriage and rest, that is, the legs are in condition shown in FIG. 3. At this time, since the legs 1, 1 are received in the recesses 3*b* of the protector 3 without any portions protruding from the protector, the legs 1, 1 of the golf bag "B" are stably protected against external shock.

Figure 4:
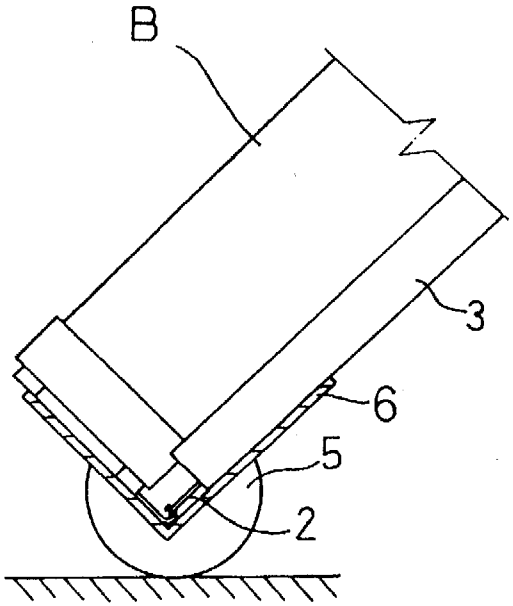
FIG. 4 is a side view a golf bag having the protector of the invention which is put on a cart.

FIG. 4 shows a golf bag having the protector of the invention which is put on a golf bag cart. As shown in the drawing, when the golf bag "B" having the protector 3 is put on a golf bag cart 5, the support member 6 of the cart 5 comes into contact with the whole outer surface of the protector 3. Hence, carriage by the cart is facilitated by the protector 3.

FIG. 5 shows the protector of the invention which functions as a stopper for legs. As shown in the drawing, when the actuating plate 4 comes into contact with the ground in order to extend the legs 1, 1, the actuating plate 4 is pivotally moved upward. When the actuating plate 4 is moved upward to a predetermined distance, the actuating plate 4 comes into contact with a bottom surface 3*d* of the protector 3, so that the actuating plate 4 and thus the legs 1, 1 are stopped. Accordingly, the extension limit of the legs 1, 1 is determined by the protector 3.

As described above, the protector according to the above embodiment has been described as functioning as a bracket as well as a protector but the protector can be used as only a protector without the bracket function.

Figure 6:
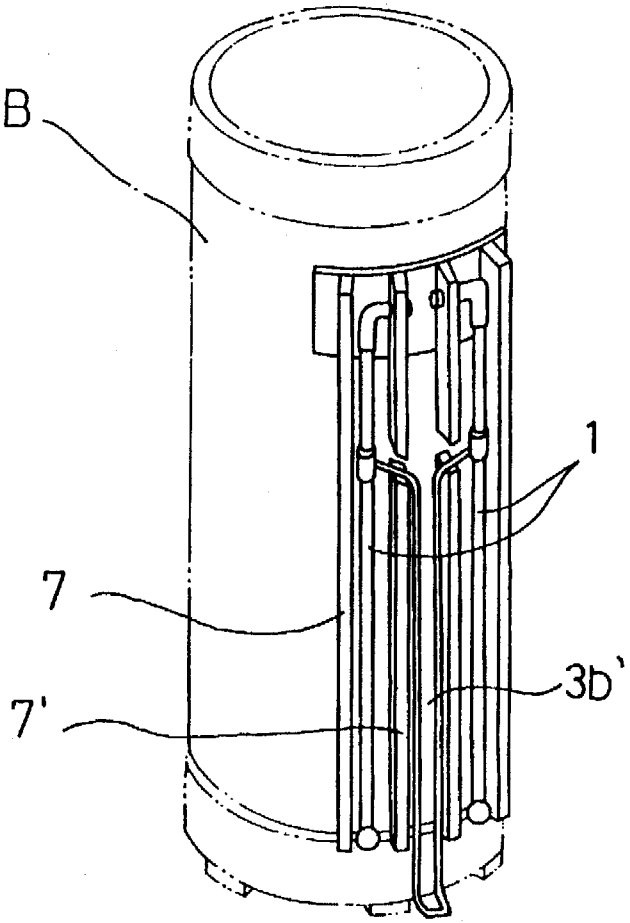
FIG. 6 is a perspective view of a protector according to another embodiment of the invention.

Referring to FIG. 6, there is shown a protector for legs of a golf bag according to another embodiment of the invention. As shown in the drawing, four rectangular bars 7, 7', that is, two outer rectangular bars 7 and two inner rectangular bars 7' are longitudinally attached to the golf bag "B" at predetermined spacings, thereby providing three recesses 3*b* there between. A pair of legs 1, 1 of the golf bag "B" are pivotally connected to upper ends of the inner bars 7'. The inner bars 7' are cut out at middle portions thereof to allow the actuating member to be received in the middle recess 3*b*'. The above type of protector has an advantage in that the protector can be manufactured at more inexpensive cost. Alternatively, the bars may be provided at only outside of the legs and may be made into various shapes such as a triangle section, a rectangular section, a pentagonal section.

Referring to 7 and 8, there are shown a protector for legs of a golf bag according to still another embodiment of the invention. A golf bag "B" according to the embodiment of the invention is provided at its outer wall with a protector 3" for legs of the golf bag. The protector 3" has an enlarged leg receiving recess 8 extending between the upper end and the lower end such that the leg receiving recess 8 is positioned inside of the outer wall of the golf bag "B". The protector 3" is adapted to receive legs 1, 1 of the golf bag "B" which are pivotally connected to upper portion of side walls 8*a* and extended and retracted by upward and downward movement of an actuating member 2. The actuating member 2 is extended downward through a hole 9 formed at a bottom wall of the protector 3". Therefore, the legs 1, 1 are normally positioned inside of the outer circumferential surface "P" of the golf bag "B" to protect the legs 1, 1 against external force and shock, as shown in FIG. 8.

As mentioned above, since the protector 3" of the invention receives the legs 1, 1 of the golf bag "B" pivotally connected thereto, the protector 3" may function as not only a bracket for pivotally supporting the legs 1, 1 but also a protector for protecting the legs 1, 1 by receiving them into the recess 8.

Figure 7:
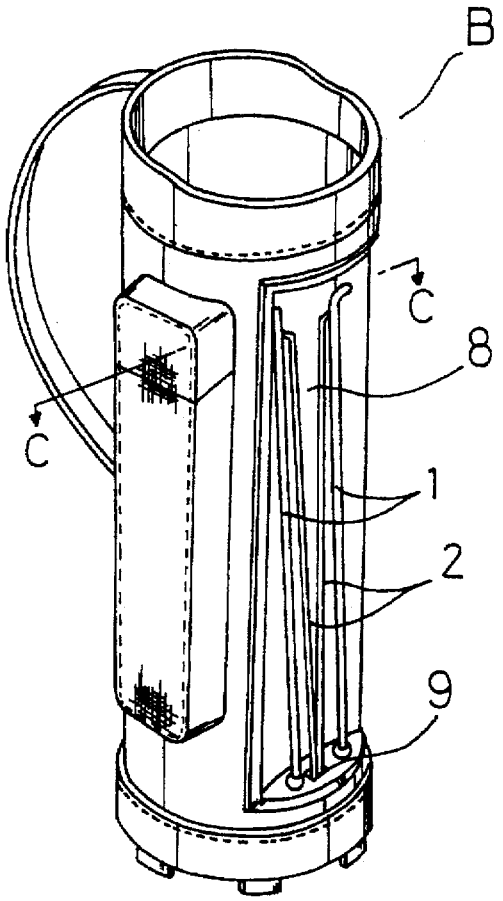
FIG. 7 is a perspective view of a protector according to still another embodiment of the invention.
Figure 8:
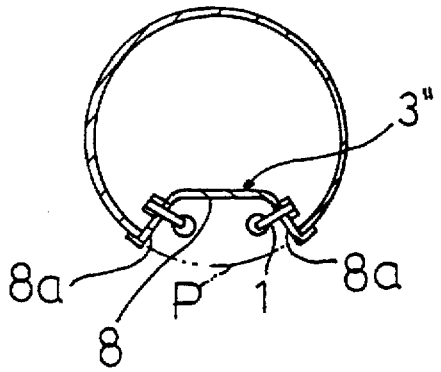
FIG. 8 is a sectional view taken along line C—C of FIG. 7.
Figure 9:
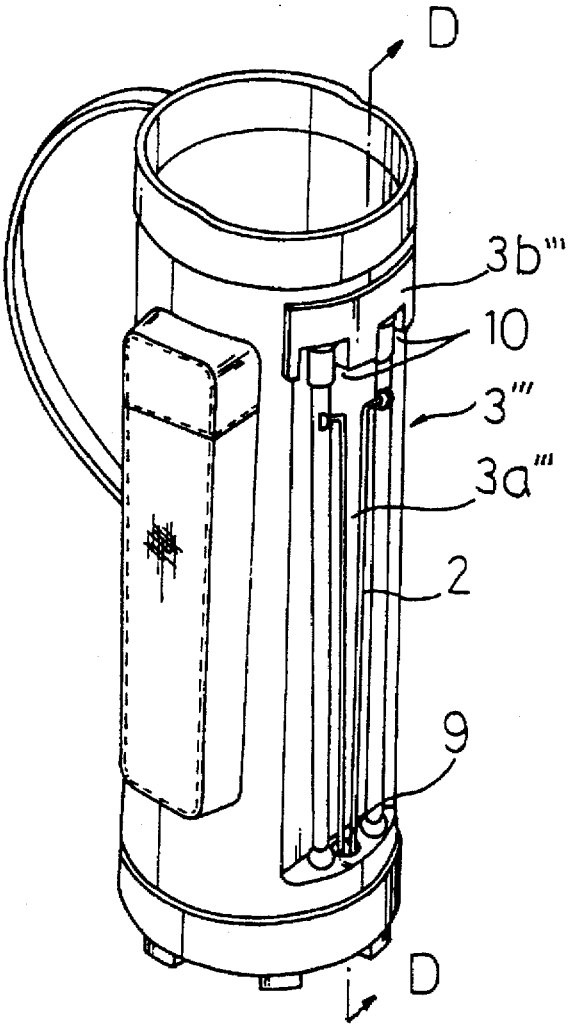
FIG. 9 is a perspective view showing a modified example of the protector shown in FIG. 8.

Referring to FIG. 9, there is shown a modified example of the protector of FIGS. 7 and 8. As shown in the drawing, the protector 3'" comprises a recess 3*a*'" made of the same material as that of the recess 3*a*'" and a support bracket 3*b*'" of plastic material which is attached to an upper portion of the recess 3*a*'" of the golf bag "B" by appropriate method. In this case, the golf bag "B" is previously formed at its outer wall with the recess 3*a*'" for receiving the legs 1, 1 and the actuating member 2. The support bracket 3*b*'" has pivot holes formed at inner side walls thereof for pivotally supporting the upper ends of the legs 1, 1 and cutout portions 10 formed at its lower end for allowing the legs 1, 1 to be extended there through.

Figure 10:
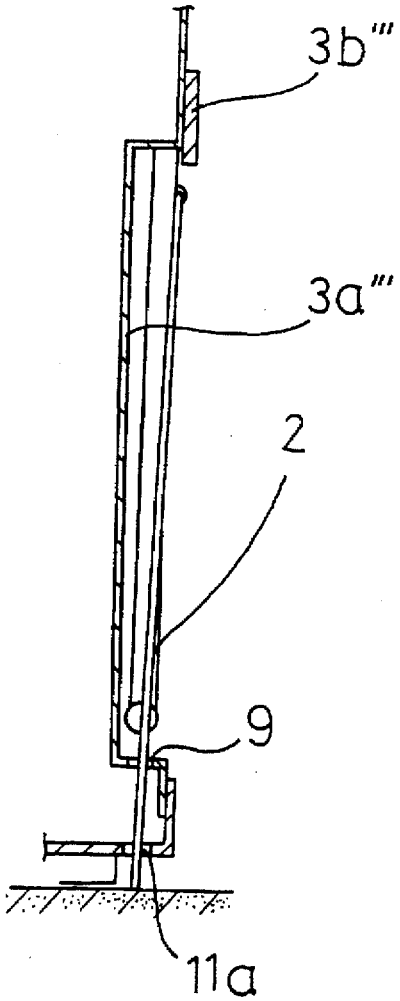
FIG. 10 is a sectional view taken along line D—D of FIG. 9.

As shown in FIG. 10, the actuating member passes through a hole 9 and a bottom hole 11*a* formed in a bottom of the golf bag "B" and comes into contact with the ground "G", the bottom hole 11*a* must be necessarily formed in the bottom of the golf bag. The bottom hole 11*a* functions to guide the actuating member 2 in cooperation with the hole 9 so that the actuating member 2 is moved vertically through the hole 9 and the bottom hole 11*a* along only a path defined by the holes 9 and 11*a*.

Figure 11:
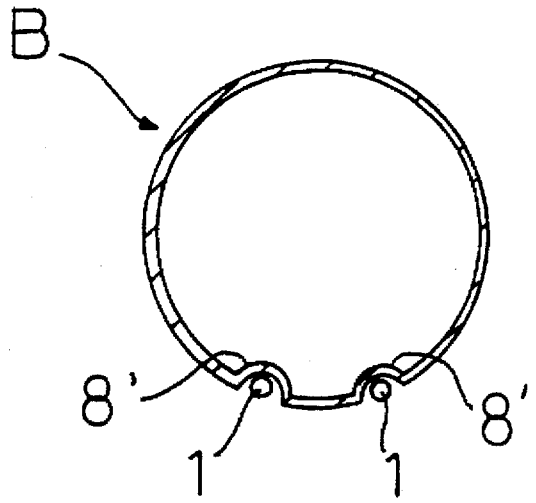
FIG. 11 is a sectional view of a protector according to still another embodiment of the invention.

FIG. 11 is a sectional view of a modification of the protector shown in FIG. 7. As shown in FIG. 11, the recess 8' comprises a pair of longitudinal grooves formed at an outer surface of the golf bag along lines corresponding to the retracted legs 1 which are adapted to receive only one leg 1 respectively. The depth of each of the grooves is such that the corresponding leg is perfectly, or partly, received in the groove.

Figure 12:
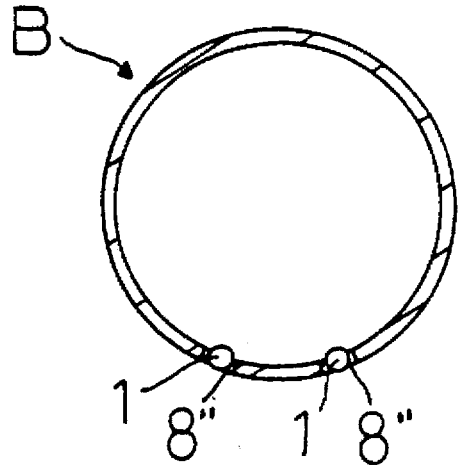
FIG. 12 is a sectional view of a protector according to still another embodiment of the invention.

FIG. 12 is a sectional view of another modification of the protector shown in FIG. 7. As similar to the grooves shown in FIG. 11, the recess 8" comprises a pair of longitudinal slits formed at an outer surface of the golf bag along lines corresponding to the retracted legs 1 which are adapted to receive only one leg respectively.

As is apparent from the above description, since the protector for legs of a golf bag according to the invention has recesses receiving legs of a golf bag, the protector can protect the legs received therein against damage by external shock. Also, since the protector comes into contact with a golf bag cart over its outer surface, a golf bag having the protector is convenient to be carried by a cart.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention:

What is claimed is:

1. A golf bag comprising a bag body having an outer wall, and a pair of legs attached to the golf bag to move between an extended and a retracted position, an actuating member for moving the legs between said extended and retracted positions, and a protector for the legs including a protector body attached to the outer wall of the golf bag and having at least one longitudinal recess for receiving the legs and the actuating member in order to protect the legs against external shock, said one recess being formed by a plurality of bars longitudinally attached to an outer wall of the golf bag with the recess formed there between, said legs having lower ends and the bars extending downward beyond said lower ends of the legs, and pivot holes in the protector body for pivotally connecting the legs thereto.

2. The golf bag of claim 1 where the recess is positioned inside of an outer circumferential surface of the golf bag.

3. The golf bag of claim 2 where the recess is formed in the outer wall of the golf bag and has a bottom surface including a through hole through which a lower end of the actuating member extends.

4. The golf bag of claim 3 where there is a bottom hole formed in a bottom of the golf bag aligned with the through hole through which the actuating member passes.

5. The golf bag of claim 1 where there are a pair of recesses, each comprising a groove for receiving only one leg.

6. The golf bag of claim 1 where there are a pair of recesses, each comprising a slit for receiving only one leg.

7. A golf bag comprising a bag body having an outer wall, and a pair of legs pivotally attached to the golf bag to move between an extended and a retracted position, an actuating member for moving the legs between said extended and retracted positions, and a protector for the legs including a protector body attached to the outer wall of the golf bag and having a pair of longitudinal recesses, each recess receiving one of the said pair of legs to protect the legs against external shock, each recess being formed by a plurality of bar elements longitudinally attached to an outer wall of the golf bag with the recess formed there between, said legs having lower ends and the bar elements extending downward beyond said lower ends of the legs.

* * * * *